US005599023A

United States Patent [19]

Loyd

[11] Patent Number: 5,599,023

[45] Date of Patent: Feb. 4, 1997

[54] PARTIALLY TRANSLUCENT MURAL DECOY

[75] Inventor: Jody Loyd, Huntsville, Ala.

[73] Assignee: Teledyne Industries, Inc., Los Angeles, Calif.

[21] Appl. No.: 539,057

[22] Filed: Oct. 4, 1995

[51] Int. Cl.[6] ..... F41J 1/00

[52] U.S. Cl. ..... 273/348.1

[58] Field of Search ..... 273/348.1, 348; 434/11

[56] References Cited

U.S. PATENT DOCUMENTS

| | | | |
|---|---|---|---|
| 2,647,336 | 8/1953 | de Montebello . | |
| 4,240,212 | 12/1980 | Marshall et al. | 273/348.1 |
| 4,260,160 | 4/1981 | Ejnell et al. | 273/348.1 |
| 4,279,599 | 7/1981 | Marshall et al. | 273/348.1 |
| 5,066,019 | 11/1991 | Dean et al. | 273/348.1 |
| 5,105,306 | 4/1992 | Ohala . | |
| 5,110,137 | 5/1992 | Watkins et al. | 273/348.1 |
| 5,186,628 | 2/1993 | Newman | 434/11 |
| 5,222,203 | 6/1993 | Obata . | |

FOREIGN PATENT DOCUMENTS

| | | |
|---|---|---|
| 689231 | 3/1953 | United Kingdom . |

*Primary Examiner*—William H. Grieb

*Attorney, Agent, or Firm*—Dickstein Shapiro Morin & Oshinsky LLP

[57] ABSTRACT

A partially translucent mural decoy containing selective translucent panels representing horizontal and other areas of the simulated target that appear brighter than surrounding areas of the target under certain conditions. When frontlit, these translucent panels present the same relative brightness as the surrounding opaque areas of the target. When backlit, these translucent panels appear brighter than the surrounding opaque areas of the target simulation, and this brighter aspect increases as the sun approaches the horizon. Thus the presentation of horizontal and similar areas of the simulated target when the target is backlit is simulated.

18 Claims, 13 Drawing Sheets

PARTIALLY TRANSLUCENT MURAL DECOY

BACKGROUND OF THE INVENTION

1. Field of the Invention

The present invention relates to two dimensional representations of objects and, more specifically, to decoys representing potential military targets used to confuse or distract military opponents.

2. Description of the Related Art

Armies and military organizations employ decoys that simulate field guns, tanks, aircraft, and other military targets, to distract enemy forces, confuse them as to the location, type and size of the deployer's forces, and to draw the enemy's fire thereby causing the enemy to futilely expend ammunition and to reveal the enemy's position. The known decoys vary in sophistication depending on the trade-off, among other things, of fidelity to the portrayed target, expected viewer range, ease of use, and cost. Some decoys are very realistic three-dimensional mock-ups that may be made of material reflective to radar and may be heated to simulate the infra-red signal of a simulated target.

Other useful decoys are two-dimensional mural graphic representations. These murals portray targets by presenting a likeness of the target consisting of a detailed, realistic artist's representation of the target or a photograph reproduced onto the two-dimensional surface. The two-dimensional surface may be rigid or may be of a flexible material suitable for folding or rolling-up. While not the ultimate in fidelity, two-dimensional mural decoys have substantial utility to armies because they are more portable, are easier to set-up and knock-down, and are cheaper than three dimensional decoys thereby constituting a smaller loss when shot-up or abandoned. Teledyne Brown Engineering produces a two-dimensional mural tank decoy with flexible backing and a collapsible, metal frame.

A drawback of prior art two-dimensional mural decoys is that their realism depends on their orientation to the sun. This aspect of two-dimensional mural decoys reduces their effectiveness during parts of the day and may restrict the deployer's options as to placement of the decoys. When existing two-dimensional mural decoys are frontlit, that is, when the sun is behind the observer, as illustrated in FIG. 1, they portray their simulated target relatively effectively. However, when existing two-dimensional mural decoys are backlit, that is, when the observer is facing the sun, as illustrated in FIG. 2, they are much less effective because horizontal surfaces of the portrayed target are not realistically portrayed.

When backlit, the sun reflects off the horizontal surfaces of a three-dimensional object causing them to appear significantly brighter to the observer facing the sun. These horizontal areas appear brighter as the sun approaches the horizon, and may appear to lose color and may appear as bright white or glare regions. This brightening phenomenon occurs to some extent without regard to the color or surface treatments of the horizontal areas of the object. The absence of bright or glare regions on backlit two-dimensional mural decoys is a significant cue to the intended observer that what they are observing is a decoy and not the real object.

Another drawback of prior art two-dimensional mural decoys is that they do not realistically portray the transition areas between lit surfaces and shadowed surfaces of backlit objects and they do not portray the change in contrast between lit surfaces and shadowed areas as the incidence of sunlight to the object changes through the course of the day.

SUMMARY OF THE INVENTION

The present invention overcomes to a great extent the drawback of prior art two-dimensional mural decoys by selectively incorporating translucent areas juxtaposed with opaque areas of the two-dimensional graphical representation on the face of the decoy. In one aspect of the present invention, the horizontal areas of the target simulated are represented in the mural decoy by translucent areas open to the back of the decoy. These translucent areas display a brightness and color appropriate for the depicted object for that region of the mural when frontlit, will appear brighter than the opaque areas next to them when backlit, and will decrease in brightness as the sun rises.

In another aspect of the invention, certain portions of the translucent areas of the decoy are varied in thickness as a technique for altering their transmittance, so that upon backlighting their brightness will vary in accordance with the corresponding regions of the decoyed object.

In another aspect of the invention, opaque dots are printed on the front of neutral colored translucent material, revealing the color of the dots when frontlit and a white or non-colored aspect when backlit.

In another aspect of the invention, the partially translucent mural decoy's ability to mimic a tank or similar vehicle is enhanced by the addition of a tube which extends from the rear of the decoy toward the ground. The tube can be self-supporting or made of opaque cloth suspended on taut lines. This tube is positioned so as to cast a shadow onto translucent material corresponding to the front upper hull region of an actual tank or similar vehicle. This shadow emulates the shadow cast by the main gun of an actual tank (or similar vehicle) onto its front hull region during backlighting conditions, with the further advantage that the perceived orientation of the false shadow can realistically mimic that of the real shadow according to the position of the sun relative to the decoy. The perceived orientation of the decoy's false gun shadow will change just as the actual gun shadow will change as the sun travels across the sky.

An object of the invention is to provide an economical improved two-dimensional mural decoy that more realistically simulates a target under all lighting conditions and especially when backlit.

Another object of the invention is to more realistically simulate the horizontal surfaces of targets depicted by two-dimensional mural decoys.

These and other objects of the present invention will become apparent from the following detailed description and appended claims.

The invention may best be understood with reference to the accompanying drawings wherein illustrative embodiments are shown.

DETAILED DESCRIPTION OF PREFERRED EMBODIMENTS

Figure 1:
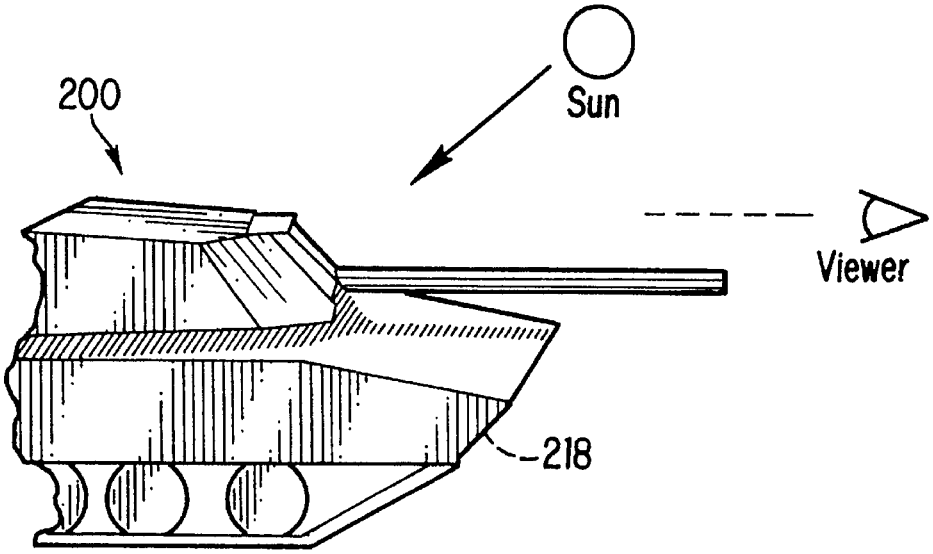
FIG. 1 is a schematic diagram illustrating the relative positions of a frontlit objects a viewer and the sun.
Figure 2:
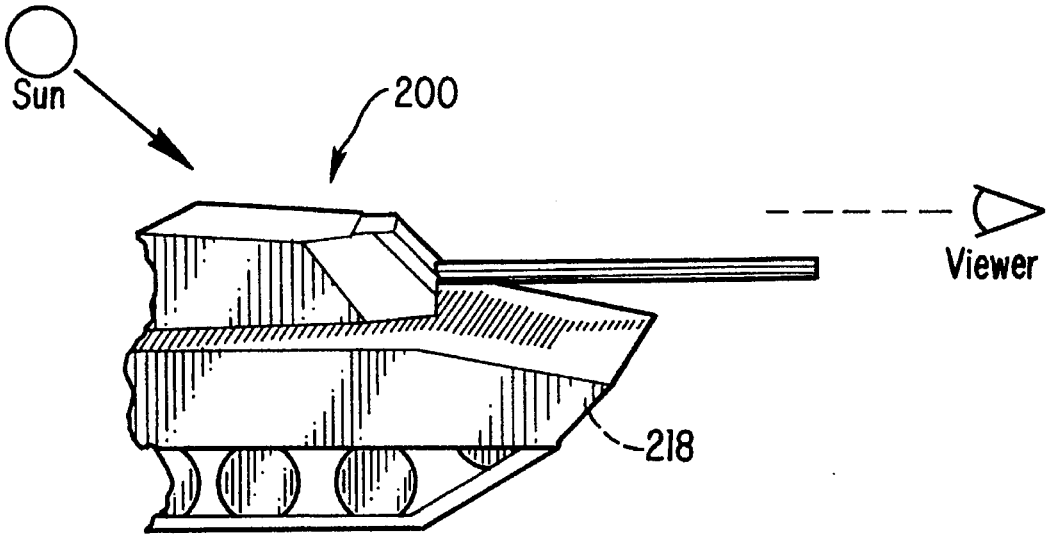
FIG. 2 is a schematic diagram illustrating the relative positions of a backlit object, a viewer and the sun.
Figure 3:
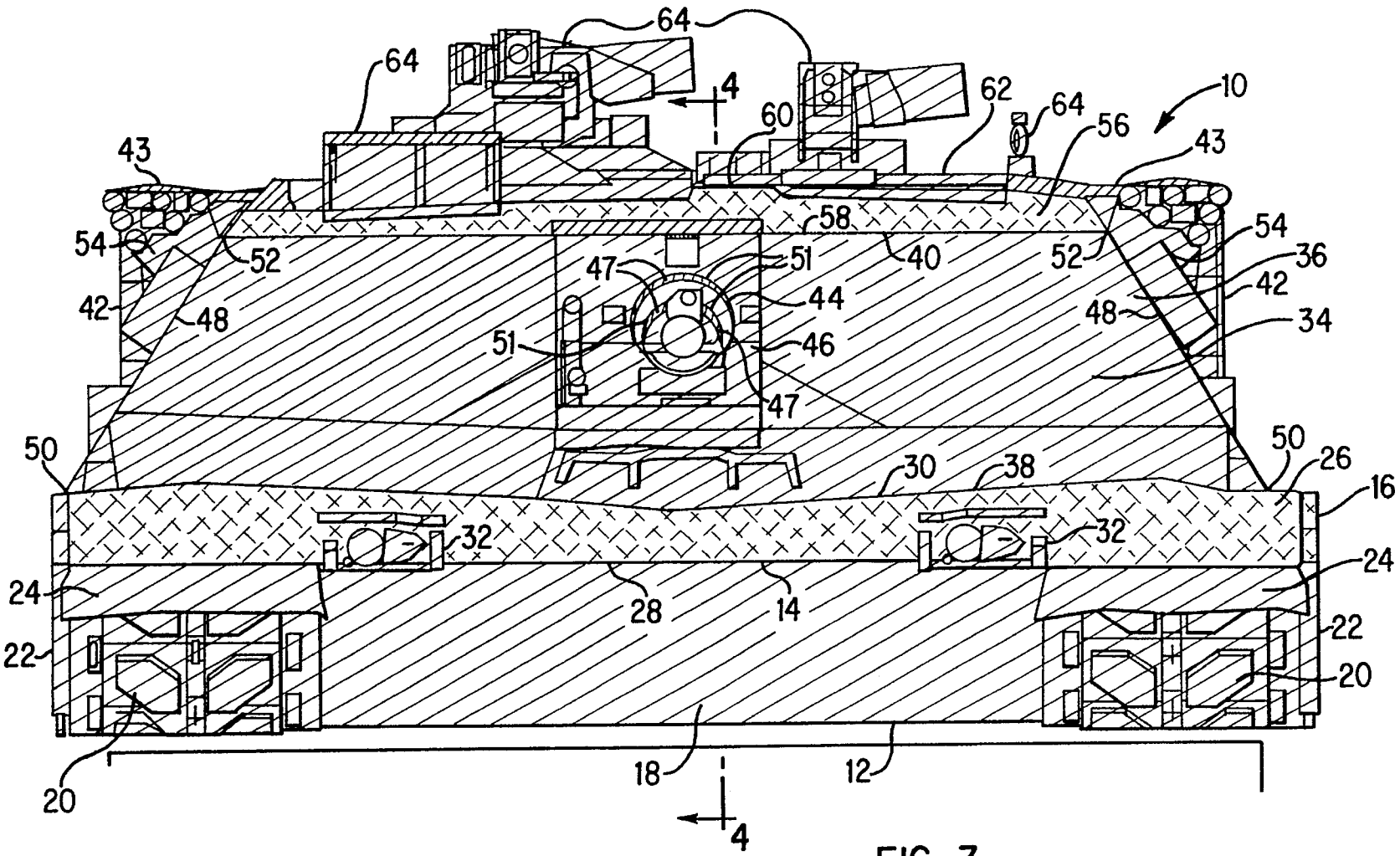
FIG. 3 is a front elevational view of a partially translucent mural decoy according to the principles of the present invention.
Figure 4:
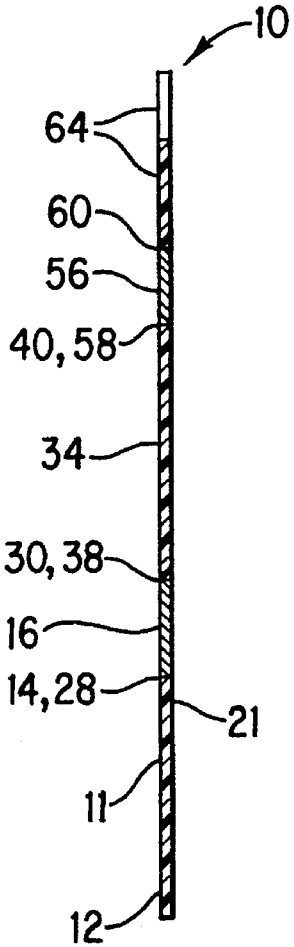
FIG. 4 is a cross-sectional view taken along line 4—4 of FIG. 3.

Referring now to the drawings wherein like reference numerals refer to similar parts throughout the drawings, there is shown in FIGS. 3 and 4 a first embodiment of a partially translucent mural decoy 10 constructed in accordance with principles of the present invention. Partially translucent mural decoy 10 is a two-dimensional graphical representation of the front of a tank 200 as it would appear to an observer facing it. A prior art opaque mural decoy 100 is also referred to below for comparison purposes. Details of tank 200 simulated by the partially translucent mural decoy 10 are set forth herein for illustrative purposes only and form no part of the claimed invention, hence the appearance of tank 200 is not exhaustively described. For convenience, the partially translucent mural decoy 10 will be described in relation to the orientation illustrated, consequently terms such as "upper" and "lower", etc. used herein are to be construed in their relative sense.

Partially translucent mural decoy 10 is supported in an upright position by an appropriate support system (not shown in FIGS. 3 and 4) deployable in the field. Such support systems are well known in the art.

A lower opaque panel 12 comprises a substantially rectangular piece of opaque vinyl with its longer dimensions horizontally disposed, on which is printed by conventional methods a detailed representation of the lower parts of tank 200, and which has an upper border 14. Front 16 of the body of tank 200 and underside 18 of the tank 200 are depicted in a central area, comprising approximately two-thirds of the area of lower opaque panel 12. At either end of lower opaque panel 12 are depicted treads 20, side armor 22 and fenders 24 of tank 200.

A lower translucent panel 26 is a substantially rectangular piece of translucent cloth, with its longer dimension horizontally disposed, of the color of, and on which may be printed by conventional methods additional detail of, the tank depicted, and has a lower border 28 adjacent upper border 14 of panel 12 and an upper border 30. Upper border 30 of lower translucent panel 26 is in the shape of a broad shallow vee extending over approximately the central four-fifths of the upper border 30 of lower translucent panel 26, and on either end of lower translucent panel 26 extends downward from the upper points of the vee at a shallow angle to the horizontal axis of the partially translucent mural decoy 10 to the ends of lower translucent panel 26. Two light groups 32, comprising opaque pieces in the shape of the front illuminating and signalling apparatus of the tank depicted on the partially translucent mural decoy 10, are placed on lower translucent panel 26, each light group 32 located approximately one-quarter of the length of lower translucent panel 26 away from the center of lower translucent panel 26 towards either side.

An intermediate opaque panel 34 is a substantially rectangular piece of opaque vinyl, with its longer dimension horizontally disposed, on which is printed by conventional methods a detailed representation of the front of the turret 36 of tank 200, and which has a lower border 38 adjacent upper border 30 of panel 26, an upper border 40, two irregular side borders 42, and two irregular upper borders 43. A major gun 44 and a gun mount 46 are depicted in the center of intermediate opaque panel 34. Three irregular holes 45 are cut into intermediate opaque panel 34. Translucent panels 47 are attached by their edges 51 to the borders of the holes 45.

At both ends of intermediate opaque panel 34 are turret outline diagonal lines 48 extending from each lower corner 50 of intermediate opaque panel 34 upward and inward to points 52 on the upper border 40 of intermediate opaque panel 34, depicting the sloped sides of the tank's turret. In upper triangular areas defined by the turret outline diagonal lines 48 and the upper border 43 and side borders 42 of intermediate opaque panel 34 are depicted side accessory groups 54. Side accessory groups 54 are graphical representations of storage boxes, smoke grenade launchers and other accessories mounted to the sides of the tank's turret. Side accessory groups 54 extend upwards past the upper border 40 of intermediate opaque panel 34.

Upper translucent panel 56 is a substantially rectangular piece of translucent cloth, with its longer dimension horizontally disposed, of the color of, and on which may be printed by conventional methods additional details of, and which has a lower border 58 and upper border 60, and which represents deck 62 of turret 36 of tank 200. Turret accessories 64 are disposed along the upper border 60 of upper translucent panel 56 and create an irregular shape in the upper border 60 of upper translucent panel 56. Turret accessories 64 are graphical representations, printed by conventional methods on opaque vinyl material, of the weapons, signaling devices, observation devices and hatches, etc. mounted to deck 62 of the turret 36 of the depicted tank 200. Alternatively, translucent panels 26, 56 of partially translucent mural decoy 10 can be made of a translucent plastic.

Each of lower opaque panel 12, lower translucent panel 26, intermediate opaque panel 34, upper translucent panel 56 and the other opaque areas of partially translucent mural decoy 10 forms a first planar surface and a second planar surface and such first and second planar surfaces 11, 21 are vertically disposed in use.

The illustrative representation of tank 200 determines the generally rectangular and planar shapes of the various panels of the partially translucent mural decoy 10 set forth herein. Panels of other shapes will be required in using the present invention to represent other objects and targets as will be apparent to those skilled in the art.

Lower translucent panel 26 is disposed and centered above lower opaque panel 12 and lower border 28 of lower translucent panel 26 is attached by conventional methods to upper border 14 of lower opaque panel 12. Intermediate opaque panel 34 is disposed and centered above lower translucent panel 26 and lower border 38 of intermediate opaque panel 34 is attached by conventional methods to upper border 30 of lower translucent panel 26. Upper translucent panel 56 is disposed and centered above intermediate opaque panel 34 and lower border 58 of upper translucent panel 56 is attached by conventional methods to upper border 40 of intermediate opaque panel 34.

Figure 13:
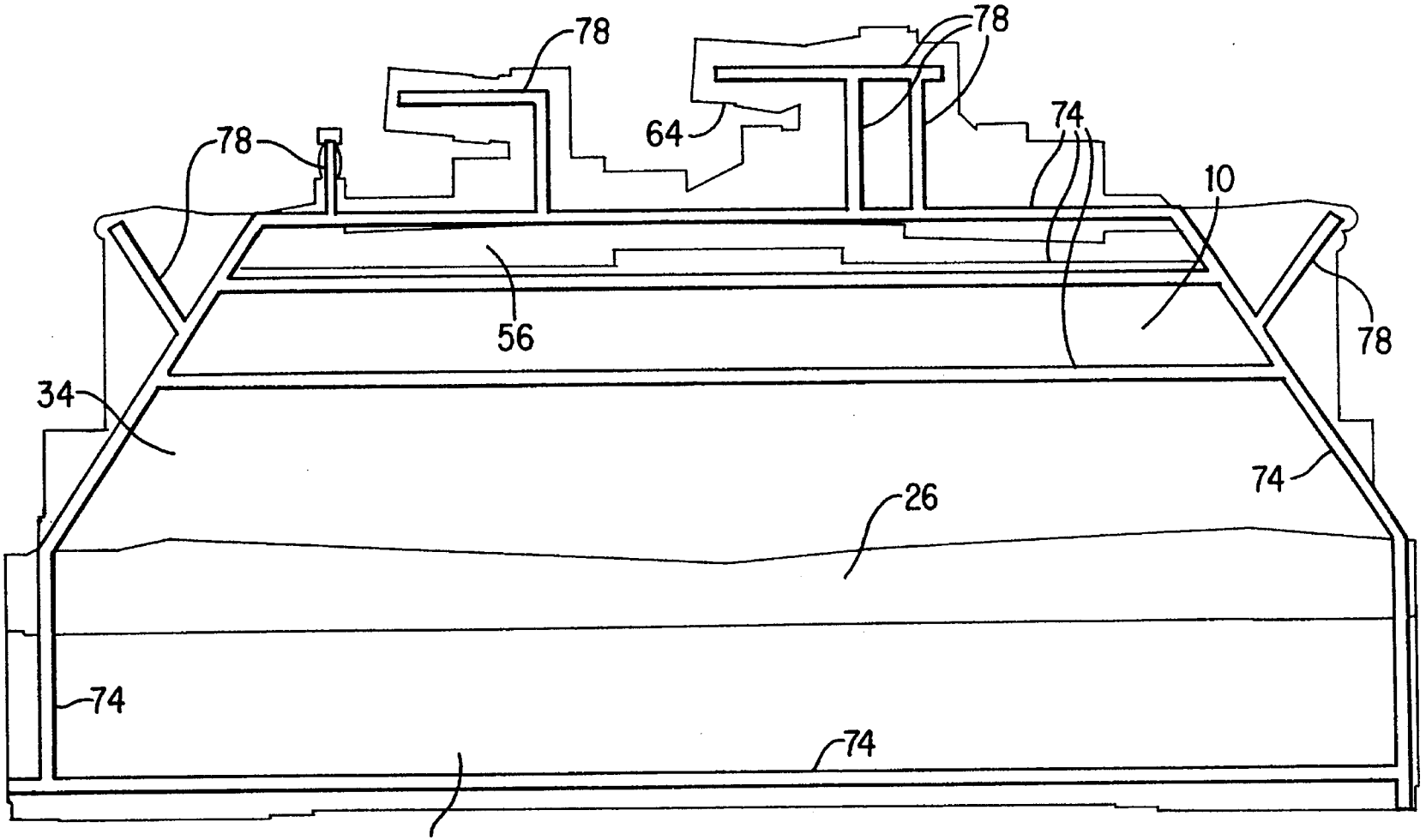
FIG. 13 is a back elevational view of a partially translucent mural decoy with a support frame.

Partially translucent mural decoy 10 is held upright by an appropriate support system deployable in the field. Such support systems are well known in the art. An example of a support system which works within the context of the present invention is shown in FIG. 13 to illustrate the minimization of interference with translucent panels. The support structure of the invention is not limited to the frame's specific geometrical shape, materials, or means of attachment between it and the decoy.

The illustrated support system is easy to assemble and produces minimum interference with the partially translucent decoy's performance.

A frame 74 of tubular metal runs along the bottom of the partially translucent mural decoy, the top, vertically along the sides from the ground to a height corresponding to the bottom of the turret of tank 200, horizontally for a short distance, and diagonally along a path corresponding to the outline of the turret of tank 200. Metal support struts 78 attach to frame 74 with the aid of a hinge to support regions of the partially translucent mural decoy corresponding to turret storage boxes and accessories of the tank depicted. The partially translucent mural decoy 10 attaches to frame 74 and support struts 78 at the time of deployment by conventional means understood by those in the art. Additional stiffness is given to the partially translucent mural decoy 10 by flexible plastic backing 76, which is attached to the back of the partially translucent mural decoy 10 by conventional means understood by those in the art. The flexible backing 76 is flexible enough to permit easy folding of the decoy for storage yet is stiff enough to prevent wrinkling on edges not directly supported by the frame such as those depicting the outline of the turret accessories 64.

Figure 14:
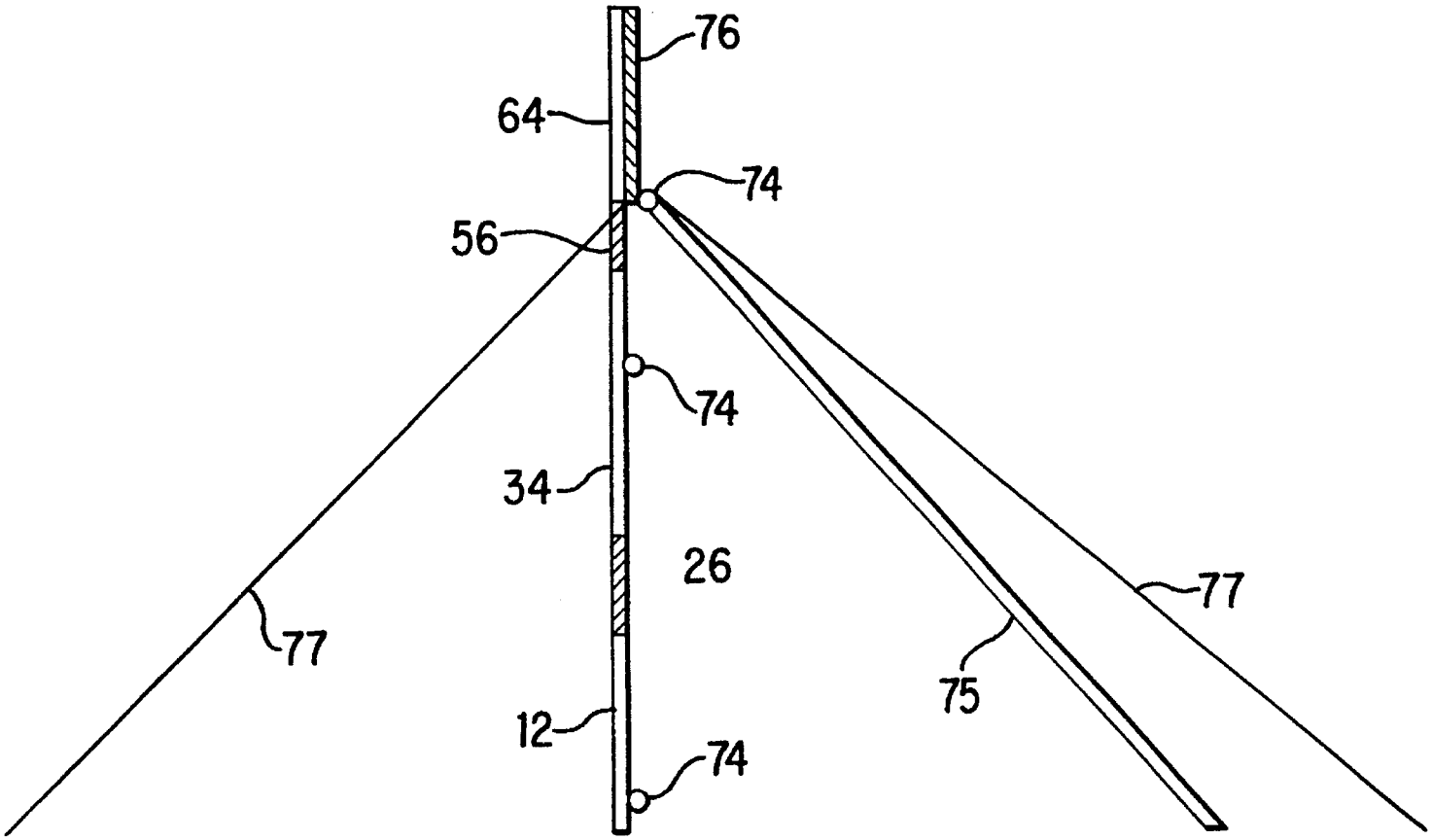
FIG. 14 is a side elevational view of a partially translucent mural decoy showing frame details.

Two support braces 75 (FIG. 14) attach to the middle horizontal member of frame 74 and slant toward the earth behind the decoy, where they are attached to the ground by stakes or other means. The braces 75 keep the decoy upright. Careful placement of elements of frame 74 such that as much of it as possible is hidden behind opaque regions of the decoy and the use of tubing with the smallest usable width mitigates the effects of shadows cast by the frame 74 on translucent panels 26, 56 during backlighting conditions. In addition, the solid poles of the support braces 75 depicted here may be replaced by open trusses of smaller tubing in order to cast less conspicuous shadows. Moreover, support lines 77 may provide enough stability such that support braces 75 may be dispensed with.

Figure 5:
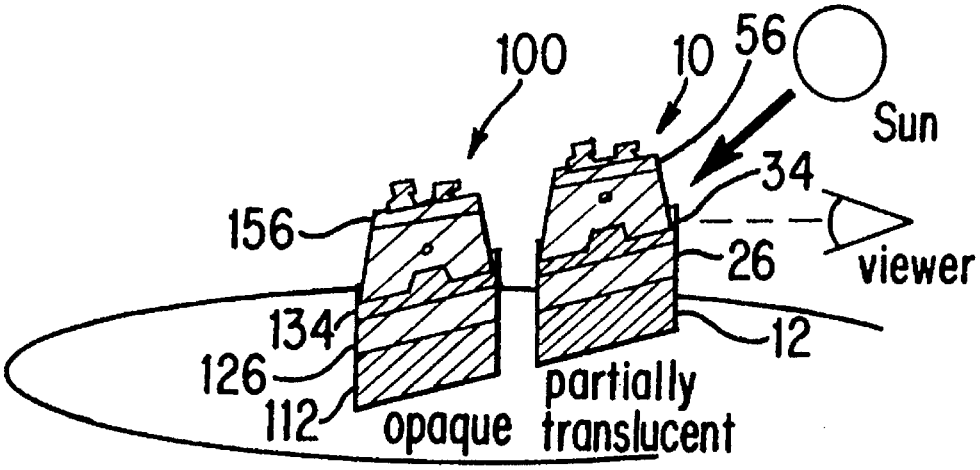
FIG. 5 is a schematic diagram showing the presentation of opaque and partially translucent mural decoys when frontlit and illustrating the relative positions of the decoys, the viewer and the sun.

In use, when partially translucent mural decoy 10 is deployed in the field it will accurately simulate the appearance of the tank it depicts under various lighting conditions as follows. When frontlit, as shown in FIG. 5, upper translucent panel 56, while diffusely transmitting some of the incident light out of sight toward the rear of the decoy, also reflects an appreciable amount of light, so that to an observer in front, upper translucent panel 56 appears as approximately as bright as region 156 of opaque mural decoy which depicts corresponding horizontal surface 256 of tank 200 shown in FIGS. 7(*a*) and 7(*b*). Similarly, lower translucent panel 26 reflects some of the light incident upon it, so that it appears approximately as bright as region 126 of opaque mural decoy 100 and corresponding surface 226 of tank 200. The rest of the partially translucent panels of the invention operate in a similar manner.

Opaque panels 12, 34, and other opaque panels of the partially translucent mural decoy reflect light in an equivalent manner to that of the corresponding regions of the opaque mural decoy, thereby exhibiting the graphic depiction of the corresponding areas of tank 200 similar to the prior art opaque mural decoy. This graphic depiction is produced on opaque panels 12, 34, and other opaque panels of the partially translucent mural decoy by conventional means understood by those in the art.

Figure 6:
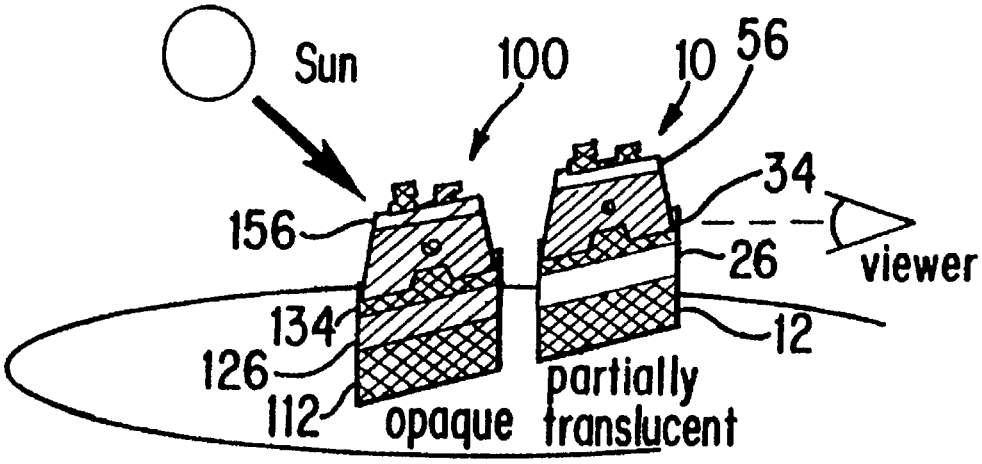
FIG. 6 is a schematic diagram showing the presentation of opaque and partially translucent mural decoys when backlit and illustrating the relative positions of the decoys, the viewer and the sun.

When backlit, as shown in FIG. 6, sunlight is transmitted through upper translucent panel 56 and lower translucent panel 26. Thus upper translucent panel 56 and lower translucent panel 26 appear markedly brighter than lower opaque panel 12, intermediate opaque panel 34 and other opaque areas of partially translucent mural decoy 10. Accordingly, under backlit conditions, the bright translucent panels 26, 56 of partially translucent mural decoy 10 accurately depict the bright light reflected by the horizontal surfaces 226, 256 of tank 200 depicted, making partially translucent mural decoy 10 a more effective simulation of a real tank.

Figure 8:
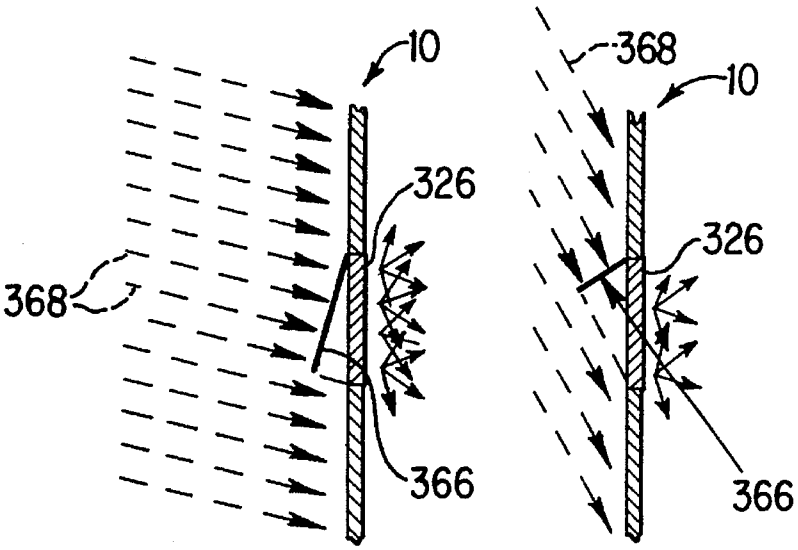
FIG. 8 is a schematic diagram illustrating the diffuse transmission of light through a translucent panel depending on the incidence of the light.

The paint on tanks and other typical military vehicles are mostly diffuse reflectors. However, for shallow angles of incidence and observation such as those shown in FIG. 7*a* for surfaces 226 and 256, common diffuse surfaces become more reflective, causing a brightening or glare. Partially translucent mural decoy 10 simulates this effect through the increased brightness of its translucent panels. As illustrated in FIG. 8, the projected area 366 of a translucent panel 326 perpendicular to the sun's rays 368 will be greater as the sun approaches the horizon than it will be with the sun high in the sky. Thus, more light will be transmitted through the translucent panel 326 as the sun approaches the horizon, and the appearance of backlit horizontal surfaces 226, 256 of tank 200 will be accurately simulated.

In contrast to the appearance of backlit translucent panels 26, 56 of partially translucent mural decoy 10, corresponding opaque panels 126, 156 of opaque mural decoy 100, as shown in FIG. 6, do not appear brighter, as would the horizontal surfaces 226, 256 of tank 200 that they depict, nor would their brightness change as the sun moves in the sky. A cue is thereby provided to intended observers that opaque mural decoy 11 is a decoy and not the real tank it is supposed to depict.

Alternatively, lower translucent panel 26 and upper translucent panel 56 are of a translucent plastic of a grayish or "neutral" color on which are printed or applied a pattern of dots of an appropriate color for the area of the tank depicted and can be printed to reproduce the image of the corresponding region of tank 200, within the limitations imposed by the neutral background. When frontlit, translucent panels 26, 56 will appear as horizontal surfaces 226, 256 of tank 200 of an appropriate color. Together with lower opaque panel 12, intermediate opaque panel 34, and other opaque panels, translucent panels 26, 56 will accurately simulate the appearance of tank 200 for this lighting condition. When backlit, translucent panels 26, 56 will be brighter than the surrounding opaque areas 12, 34, and as the sun approaches the horizon the translucent panels 26, 56 will become progressively brighter, washing out the color of the translucent panels 26, 56, making them appear as a white or glare region.

Figure 9:
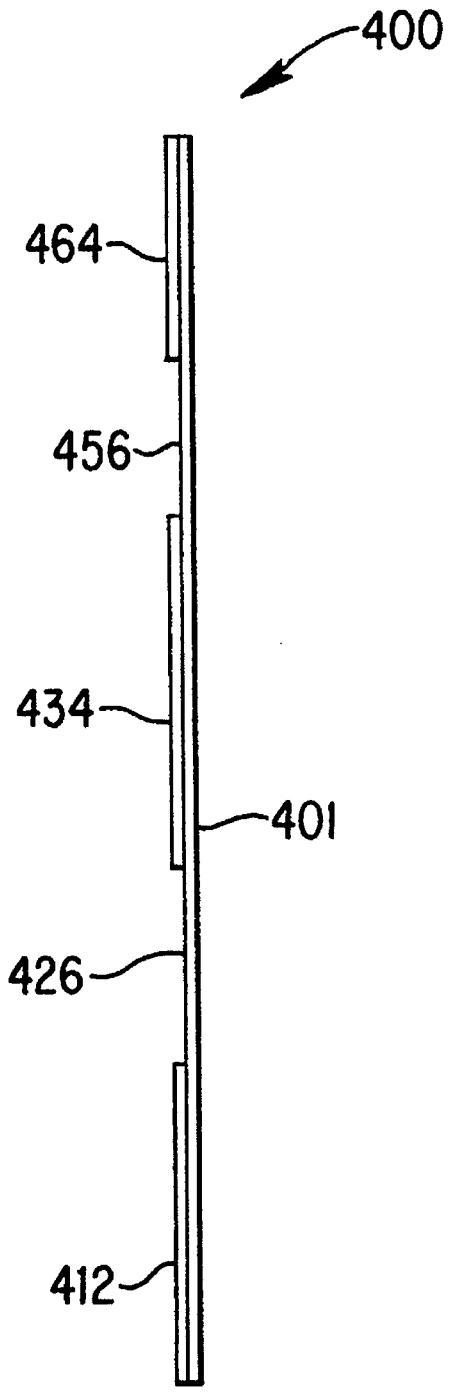
FIG. 9 is a side elevational view of a partially translucent mural decoy according to the present invention showing an alternative embodiment where the invention consists of a continuous piece of translucent material to the front of which is attached opaque panels.

In a second embodiment of the invention shown in FIG. 9, partially translucent mural decoy 400 comprises one continuous piece of translucent material 401 of the appropriate color that encompasses the entire frontal area of partially translucent mural decoy 400, to the front surface of which are attached in the appropriate places by conventional methods lower opaque panel 412, intermediate opaque panel 434 and the other opaque areas representing the non-horizontal areas of tank 200.

Figure 10:
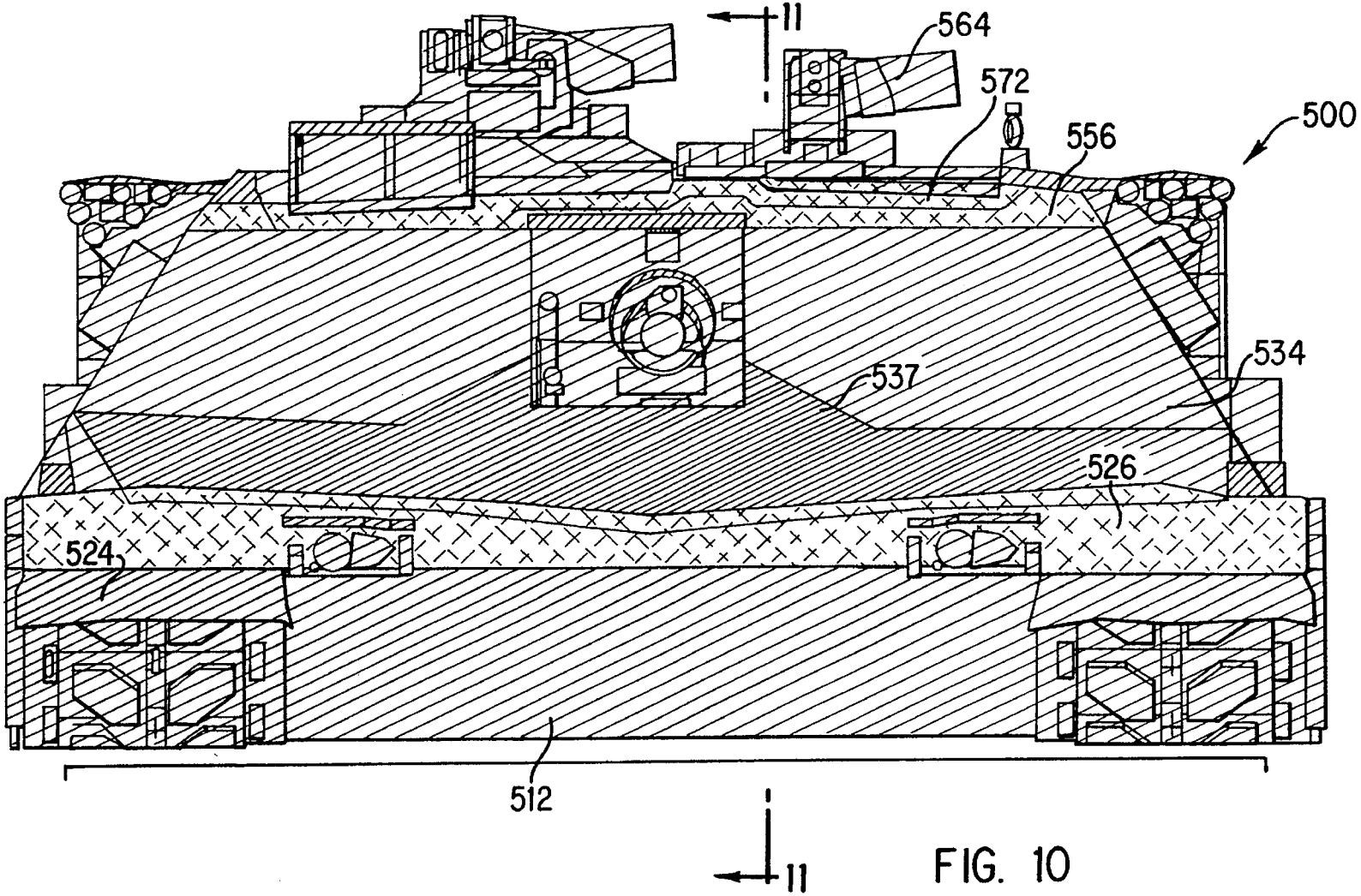
FIG. 10 is a front elevational view of a partially translucent mural decoy according to the present invention showing an opaque transitional region.
Figure 11:
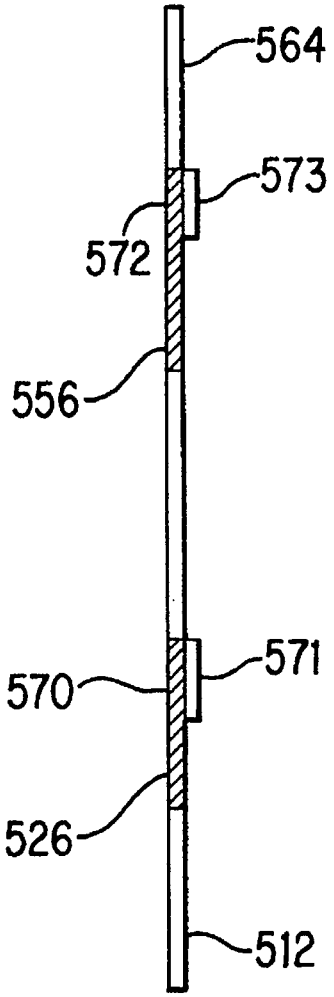
FIG. 11 is a cross-sectional view taken along line 11—11 of FIG. 10.

Refer now to FIGS. 10 and 11 for a third embodiment of the present invention. In FIG. 10, there is shown a partially translucent mural decoy 500. In this embodiment, there is an opaque transitional region 570 between lower translucent panel 526 and lower opaque panel 512, running under the decoy's depiction of shadow 537 of turret 36. The transitional opaque region 570 is a continuation of lower translucent panel 526 onto the back of which is attached by conventional means a dark, opaque panel 571. Transitional opaque panel 570 has the same appearance as lower translucent panel 526 when frontlit, so that together they represent the upper hull region of tank 200 under direct sunlight.

Figure 7A:
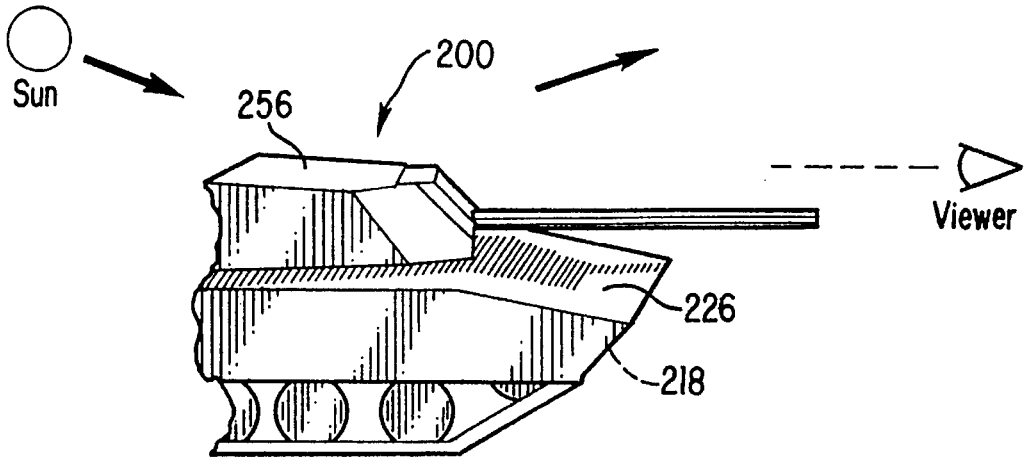
FIGS. 7(*a*) and (*b*) are schematic diagrams illustrating the reflection of light off a horizontal surface from the sun when it is at different points in the sky and illustrating the relative positions of the decoys, the viewer and the sun.
Figure 7B:
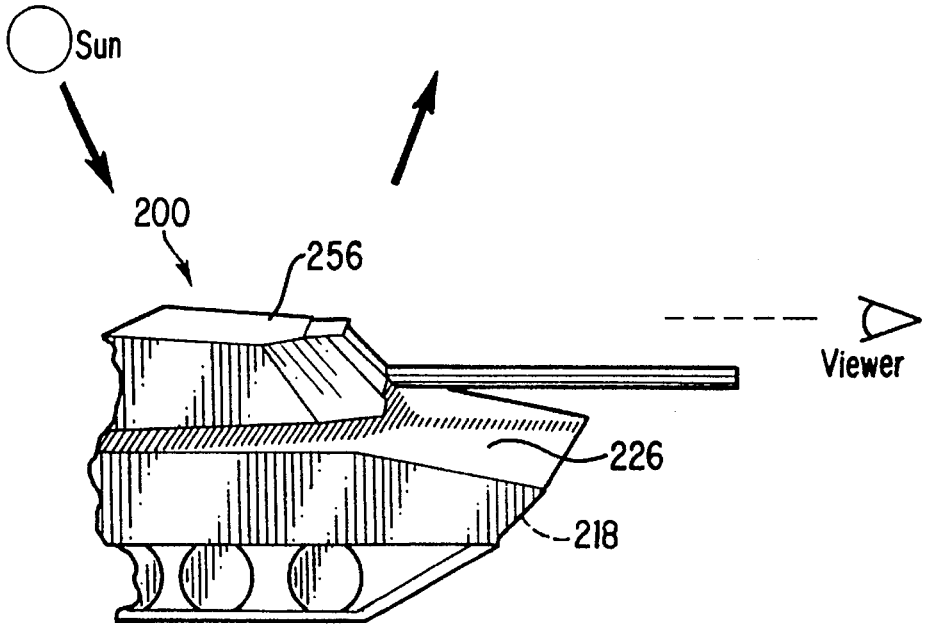

Under backlighting conditions, light will be transmitted through lower translucent panel 526 but not transitional opaque region 570, giving the appearance that shadow 537 cast from turret 36 has lengthened along the upper front hull of tank 200 (as in FIG. 7*a*, compared to FIG. 7*b*). Thus, a dynamic aspect is introduced to the invention so that it passively adjusts the appearance of turret shadow 537 to enhance visual accuracy. Transitional opaque region 572 is an extension of upper translucent panel 556 and creates an identical effect to that of transitional opaque region 570. Transitional opaque region 572 creates the illusion of shadows in front of turret accessories 564 under backlighting conditions, using opaque panel 573 attached to the back of the decoy.

Alternatively, transitional opaque regions 570, 572 can be made opaque by the application of opaque colorants by printing or other conventional means to either their front or back surfaces.

Alternatively, transitional opaque region 570 may be an extension of intermediate opaque panel 534 that has been colored or printed to closely match the appearance of lower translucent panel 526 under frontlit conditions. Similarly, transitional opaque region 572 is an extension of opaque panel 564 that has been colored or printed to closely match the appearance of upper translucent panel 556 under frontlit conditions.

Figure 12:
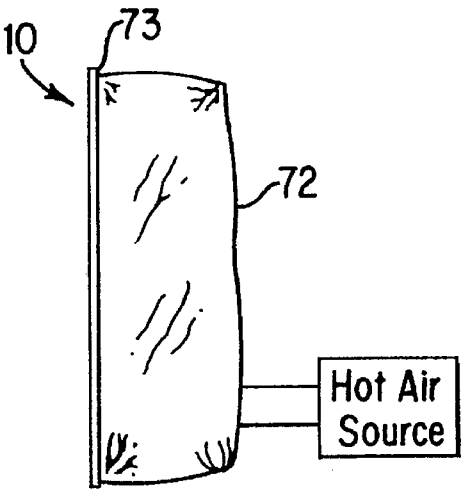
FIG. 12 is a side elevational view of a partially translucent mural decoy illustrating heating means attached to one surface of the decoy.

In FIG. 12 is shown a fourth embodiment of the invention. In this embodiment, partially translucent mural decoy 10 may be heated by attaching a clear plastic bag 72 to rear surface 73 of the decoy 10, through which hot air is circulated by conventional methods in order to simulate the heat signature of tank 200 under observation by infra-red detecting devices. The bag 72 is capable of transmitting light therethrough to the rear surface 73 of the decoy 10. This embodiment may be used with the other illustrated embodiments of the invention.

Figure 16:
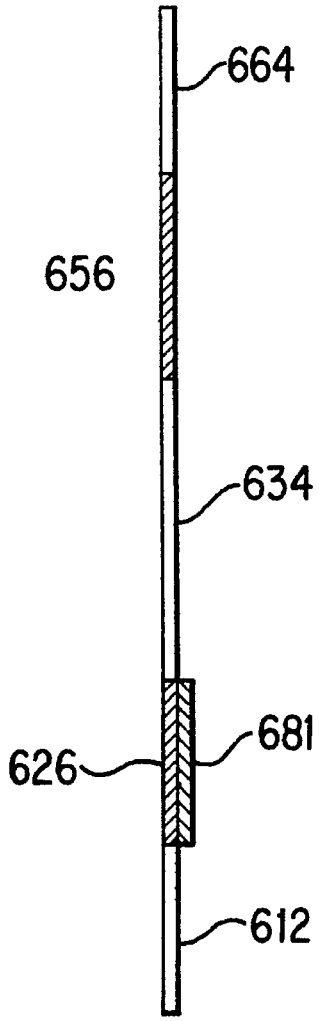
FIG. 16 is a cross-sectional view taken along line 16—16 in FIG. 15.
Figure 15:
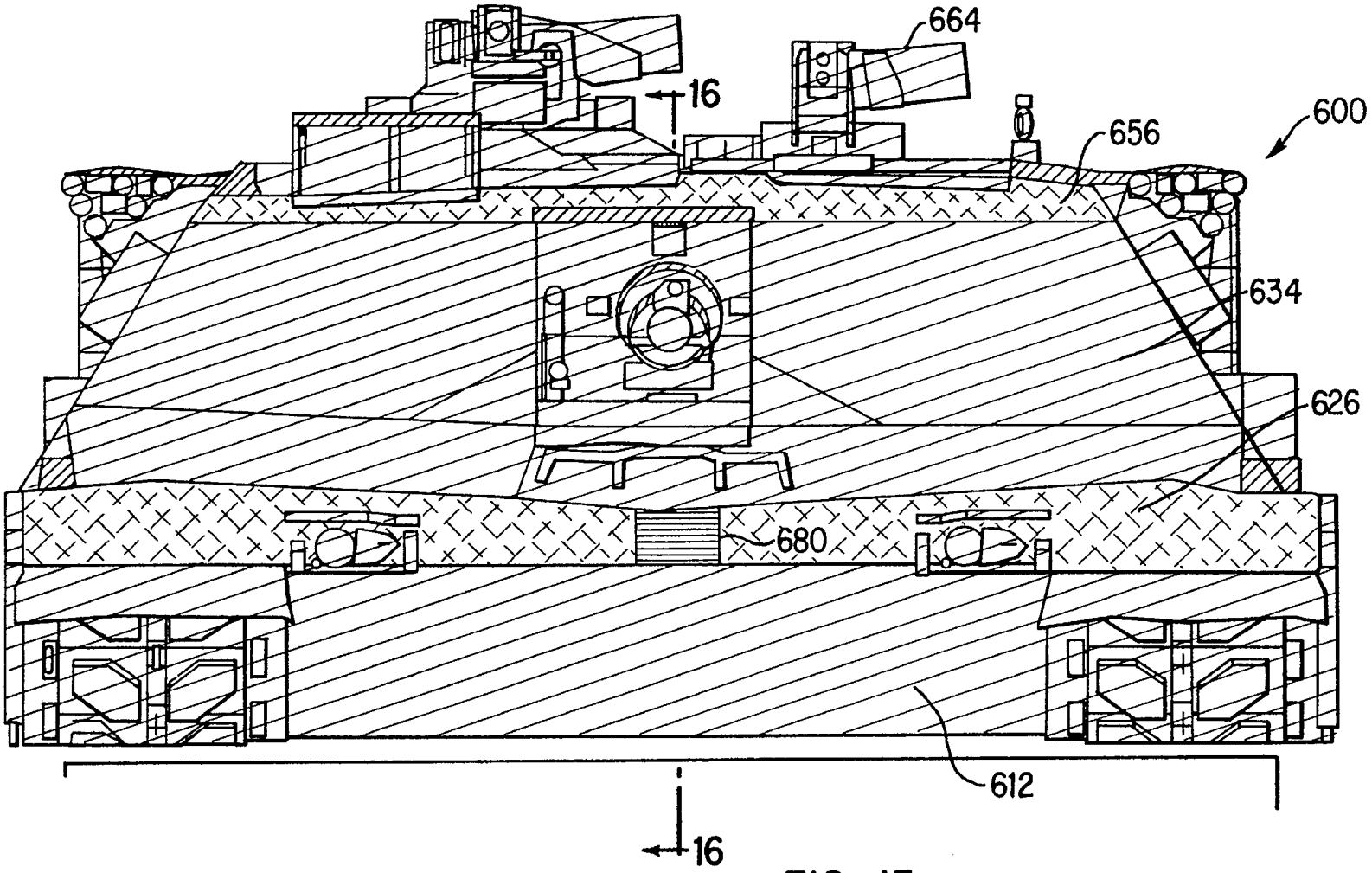
FIG. 15 is a front elevational view of a partially translucent mural decoy showing a graphic depiction of a main gun shadow.

Refer now to FIGS. 15 and 16 for a fifth embodiment of the invention. In FIG. 15, there is shown a partially translucent mural decoy 600. In this embodiment, an image of a main gun shadow 680 is depicted through conventional means onto lower translucent panel 626. The shadow image can be produced using opaque inks or paints so that the appearance of an actual shadow is maintained under backlighting conditions. Alternatively, gun shadow image 680 can be shaded by an opaque panel 681 which is the same width of gun shadow image 680 and attached to the rear of the invention using conventional means directly behind gun shadow image 680.

Figure 17:
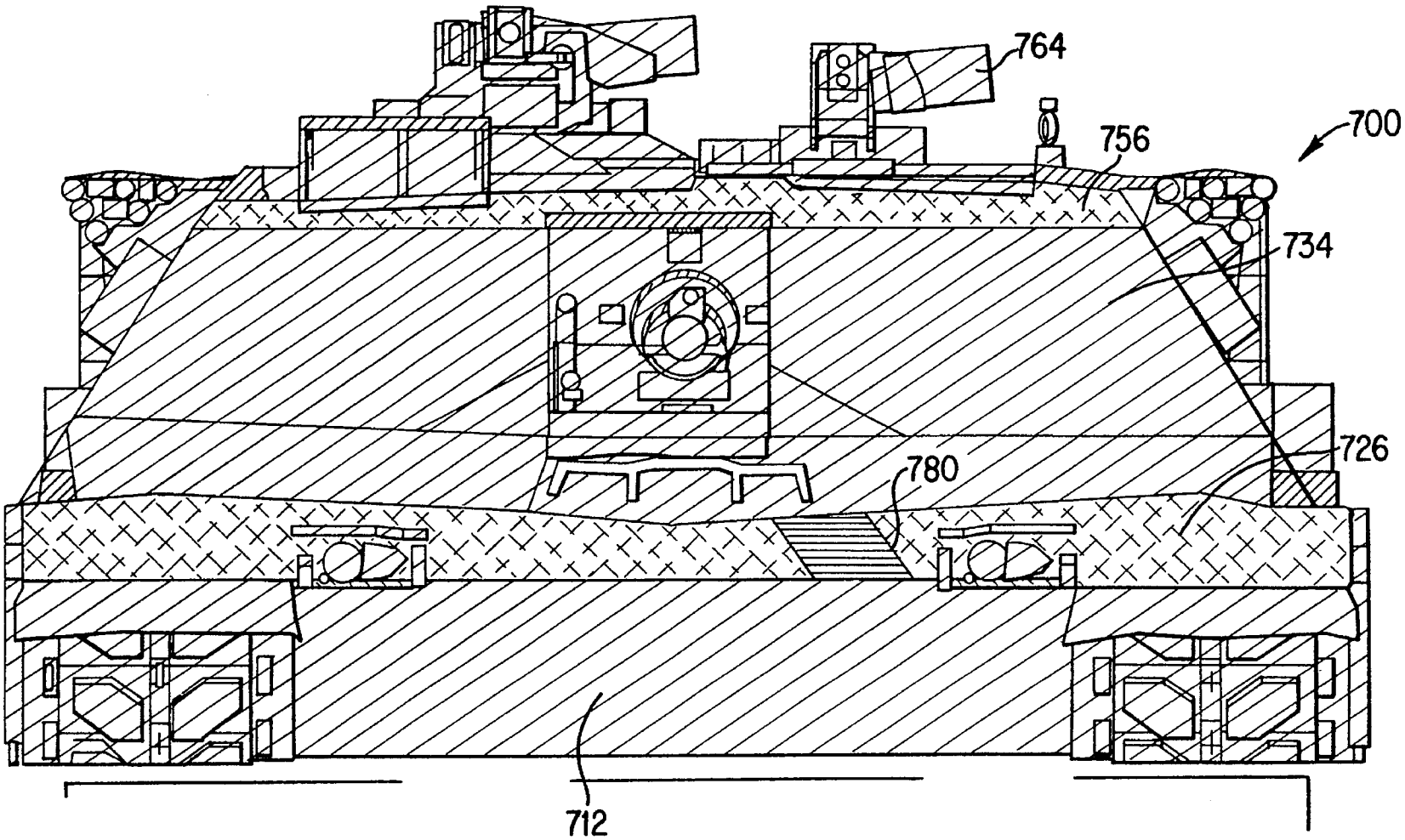
FIG. 17 is front elevational view of a partially translucent mural decoy showing the appearance of a shadow projected by a shadow-producing structure in the rear.
Figure 18:
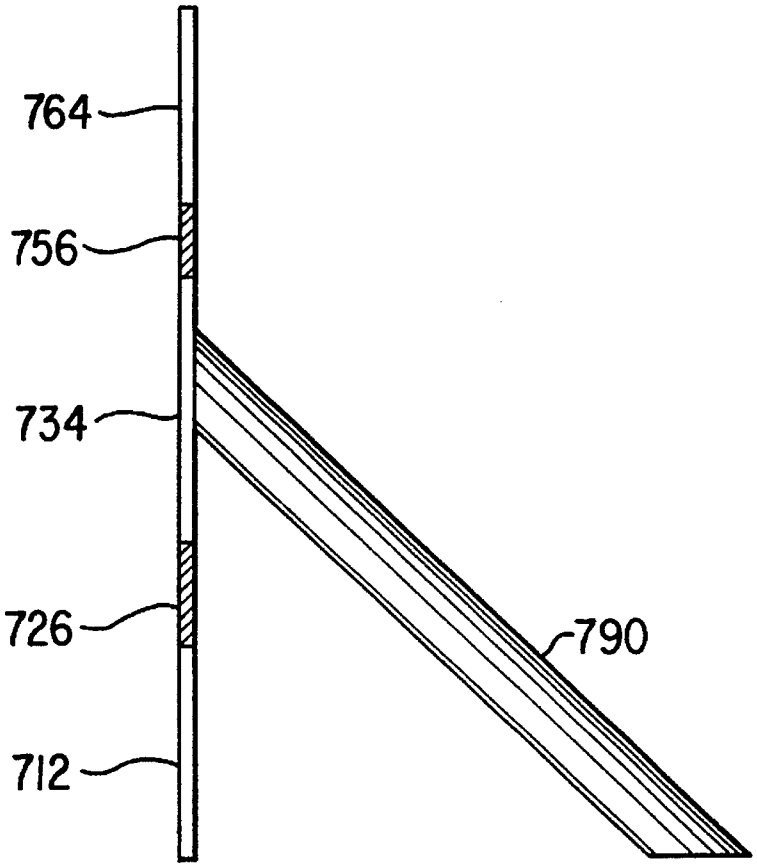
FIG. 18 is side elevational view of a partially translucent mural decoy with a shadow producing structure in the rear.

Refer now to FIGS. 17 and 18 for a sixth embodiment of the invention. In FIG. 17, there is shown a partially translucent mural decoy 700. In this embodiment, an opaque tube 790 is attached solidly to the support frame and runs downward toward the ground behind the partially translucent mural decoy for the purpose of casting a shadow upon lower translucent panel 726 under backlighting conditions. The shadow thus produced will be apparent to an observer in front of the invention and will simulate the shadow of the main gun falling upon the upper front hull region of tank 200.

The tube 790 is approximately the diameter of the main gun and must, for operational reasons, remain hidden behind the rest of the partially translucent mural decoy from observers located in front of the decoy or to either site within 45° of the line perpendicular to the mural decoy. This constrains the tube length projected to the ground to approximately one half the width of the partially translucent mural decoy along its base. The tube 790 as depicted is solid all the way to the ground where it is rigidly attached and may be used for structural support, augmenting, or perhaps replacing, support braces 75 in FIG. 14. Alternatively, the shadow-producing tube 790 may be solid but supported with a rope line or the tube 790 may merely be an inverted trough constructed of opaque cloth supported on several lines. The shadows produced in this manner will move with response to sun position, much as real gun shadows would.

It is envisioned that in this invention, the thickness, density and material of the translucent panels, the patterns printed on the face of the various panels, and the use of various opaque, non-opaque and half-tone inks and paints may be selected in order to simulate the appearance of surfaces and transition areas of various objects with differing composition and orientations under different lighting conditions. As will be appreciated by those skilled in the art, objects other than tanks, such as trucks and parked aircraft and the like, may be effectively and economically simulated using the features of the present invention.

The above description is intended to illustrate preferred embodiments which can achieve the objects features and advantages of the present invention. It is not intended that the present invention be limited thereto. Any modification coming within the spirit and scope of the following claims is to be considered part of the present invention.

What is claimed as new and desired to be protected by Letters Patent of the United States is:

1. A two-dimensional mural simulating a three-dimensional object, the three-dimensional object having horizontal surfaces and non-horizontal surfaces, said mural comprising:

a panel having a first surface and a second surface and having at least one opaque portion and at least one translucent portion, said panel having a graphical representation printed on one of said first and second surfaces on at least one of said opaque portions thereof, each of said at least one translucent portions and each of said at least one opaque portions extending between said first surface and said second surface such that the horizontal surfaces of the three-dimensional object are simulated by said at least one translucent portion which transmits sunlight therethrough when backlit and which reflects sunlight therefrom when frontlit and the non-horizontal surfaces of the three-dimensional object are simulated by said at least one opaque portion.

2. A two-dimensional mural decoy simulating a three-dimensional target, the three-dimensional target having horizontal surfaces and non-horizontal surfaces, said mural comprising:

a panel having a first surface and a second surface and having at least one opaque portion and at least one translucent portion, said panel having a graphical representation printed on one of said first and second surfaces on at least one of said opaque portions thereof, each of said at least one translucent portions and each of said at least one opaque portions extending between said first surface and said second surface such that the horizontal surfaces of the three-dimensional target are simulated by said at least one translucent portion which transmits sunlight therethrough when backlit and which reflects sunlight therefrom when frontlit and the non-horizontal surfaces of the three-dimensional target are simulated by said at least one opaque portion.

3. The decoy as recited in claim 2, wherein said translucent portion is of cloth.

4. The decoy as recited in claim 2, wherein said translucent portion is of plastic.

5. The decoy as recited in claim 2, wherein selected translucent portions are of different thicknesses.

6. The decoy as recited in claim 2, wherein selected translucent portions are of material of differing density of composition.

7. The decoy as recited in claim 2, wherein selected translucent portions are of a color matching the corresponding area of the simulated target.

8. The decoy as recited in claim 2, wherein a selected translucent portion is of a neutral color and contains a tinted surface.

9. The decoy as recited in claim 2, wherein a selected translucent portion is of a neutral color.

10. The decoy as recited in claim 2, wherein dots of a selected color are printed on said translucent portion.

11. The decoy as recited in claim 2, wherein at least one translucent portion transmits less light than the other translucent portions.

12. The decoy as recited in claim 2, further comprising a clear bag disposed on one side of said panel, said bag capable of transmitting light therethrough.

13. The decoy as recited in claim 12, further comprising means for supplying warm air to said bag to heat the decoy such that said decoy appears warm under infra-red observation.

14. The decoy as recited in claim 2, wherein said at least one translucent portion comprises the entire surface area of said panel, and said at least one opaque portion is applied to one of said first and second surfaces.

15. The decoy as recited in claim 2, wherein said panel includes a translucent material which is overprinted on the front with colored, opaque media to achieve opaqueness.

16. The decoy as recited in claim 2, wherein said panel is of a translucent material and translucent, colored media is printed on said first surface of said panel and opaque media is printed on said second surface of said at least one opaque portion.

17. The decoy as recited in claim 2, wherein said panel is of a translucent material and translucent, colored media is printed on said first surface of said panel and opaque material is attached to said second surface of said at least one opaque portion.

18. The decoy as recited in claim 2, wherein an opaque structure is located to create shadows on said at least one translucent portion under backlighting conditions, said shadows being visible from the front of the decoy.

* * * * *